United States Patent [19]

Milgram et al.

[11] 4,440,523

[45] Apr. 3, 1984

[54] SEPARATING COLLECTOR FOR SUBSEA BLOWOUTS

[75] Inventors: Jerome H. Milgram, Arlington; James Burgess, Cambridge, both of Mass.

[73] Assignee: Massachusetts Institute of Technology, Cambridge, Mass.

[21] Appl. No.: 505,051

[22] Filed: Jun. 16, 1983

[51] Int. Cl.[3] ..... E02B 17/00; E02D 23/00

[52] U.S. Cl. ..... 405/60; 210/923; 405/210

[58] Field of Search ..... 405/60, 210, 195, 52; 166/357, 79; 210/923, 170

[56] References Cited

U.S. PATENT DOCUMENTS

| | | | |
|---|---|---|---|
| 739,377 | 9/1903 | Bell . | |
| 1,830,061 | 11/1931 | Howe . | |
| 1,858,241 | 5/1932 | Giles . | |
| 1,859,606 | 5/1932 | Sievern et al. . | |
| 2,112,845 | 4/1938 | Howell . | |
| 2,479,787 | 8/1949 | Stevens . | |
| 3,211,223 | 10/1965 | Hoch . | |
| 3,312,069 | 4/1967 | Jorda | 405/264 X |
| 3,389,559 | 6/1968 | Logan | 405/60 |
| 3,429,128 | 2/1969 | Stafford et al. | 405/210 |
| 3,469,402 | 9/1969 | Lowd | 405/62 |
| 3,500,841 | 3/1970 | Logan | 137/1 |
| 3,535,884 | 10/1970 | Chaney | 405/210 |
| 3,548,605 | 12/1970 | Paoll et al. | 405/60 |
| 3,554,290 | 1/1971 | Verdin | 169/2 |
| 3,599,434 | 8/1971 | Missad | 405/60 |
| 3,610,194 | 10/1971 | Siegel | 405/60 X |
| 3,643,447 | 2/1972 | Pogonowski | 405/210 |
| 3,643,741 | 2/1972 | Miranda | 405/60 X |
| 3,653,215 | 4/1972 | Crucet | 405/60 |
| 3,658,181 | 4/1972 | Blair | 210/170 |
| 3,664,136 | 5/1972 | Laval et al. | 405/60 |
| 3,665,721 | 5/1972 | Wyllie | 405/210 |
| 3,681,923 | 8/1972 | Hyde | 405/60 |
| 3,695,047 | 10/1972 | Pogonowski et al. | 405/210 |
| 3,719,048 | 3/1973 | Arne et al. | 405/210 X |
| 3,745,773 | 7/1973 | Cunningham | 405/60 |
| 3,762,548 | 10/1973 | McCabe | 405/60 X |
| 3,779,024 | 12/1973 | Greve | 405/210 |
| 3,813,887 | 6/1974 | Kruger et al. | 405/188 |
| 3,879,951 | 4/1975 | Mason | 405/60 |
| 3,943,724 | 3/1976 | Banzoli et al. | 405/205 |
| 3,981,154 | 9/1976 | Hix | 405/60 |
| 4,283,159 | 8/1981 | Johnson et al. | 166/364 X |
| 4,395,157 | 7/1983 | Cunningham | 405/60 |

OTHER PUBLICATIONS

Milgram, J., "Subsea Collection of Oil from a Blowing Well," *OCS Oil and Gass Operations Technical Report 1981. Open-File Report 81-704, Research and Development Program, Conservation Division;* U.S. Geological Survey, pp. 71-78.

*Primary Examiner*—Dennis L. Taylor

*Attorney, Agent, or Firm*—Arthur A. Smith, Jr.; John N. Williams

[57] ABSTRACT

A collector apparatus and method for use with a blown-out seabottom wellhead comprising a plurality of collector elements each having an extended, open base and an upper portion enclosing a volume to receive fluid comprising gas and lesser quantities of oil rising, in the water, from the wellhead, and risers connected to the collector elements and extending thereabove to conduct fluid therefrom. One collector element is disposed below at least one other collector element with an open volume defined therebetween, the first element positioned to intercept fluid rising from the wellhead, and the second element positioned to receive and collect excess flow of fluid that is not collected by the first element. A riser extends from the first collector element to the surface of the sea, and a second riser extends from the second collector element to a storage tank above the second collector element. The first riser includes an adjustable valve adapted to restrict flow through the riser whereby only a portion of gas from the blown-out wellhead is allowed to flow through the first riser and a further portion of gas and oil are rejected by the first collector element and flow into the second collector element, and the second riser is adapted to conduct gas in a gas-lift pumping flow rate capable of carrying water and accompanying oil from the second collector element to the storage tank.

11 Claims, 6 Drawing Figures

SEPARATING COLLECTOR FOR SUBSEA BLOWOUTS

The Government has rights in this invention pursuant to Contract Number 14-08-0001-18611 awarded by the U.S. Department of the Interior/Geological Survey.

BACKGROUND OF THE INVENTION

This invention relates to a device for collecting oil and gas escaping from a seabottom wellhead blow-out, i.e. an uncontrolled eruption.

Blowouts from subsea wells usually contain oil, water and, initially, substantial quantities of gas. Upon reaching the surface the gas either burns or escapes to the atmosphere. However, even if there is a surface fire, most of the oil remains unburned and causes marine pollution. Several technologies have been developed for dealing with the surface oil to try to minimize pollution, with varying degrees of success.

Attempts at subsurface collection include an umbrella shaped fabric device used at the Santa Barbara blowout of about 10 years ago. This device was placed near the surface well after the blow-out had occured to collect rising oil. The oil was then pumped out of the top of the umbrella.

Another attempt at subsurface collection was made at the IXTOC well in Campeche Bay in 1979. In this case an inverted steel cone was installed above the well head after the blow-out with the cone below the ocean surface. The device was supported on a cantilever truss from a fixed platform on the ocean surface. Any oil and gas that were collected were conducted to the surface through a marine riser by means of the gas-lift process, i.e. the buoyancy of the gas provided the pumping force.

Other subsurface collection devices are shown in Miranda U.S. Pat. No. 3,643,741, where a hollow cone is secured to the ocean floor over a leaking fissure to collect leaking oil and conduct it to a storage tank; in Johnson et al. U.S. Pat. No. 4,283,159, where a dome is manuevered over a blow-out wellhead with a top valve left open to vent escaping gas as the dome is seated and sealed to collect escaping gas and oil; and in Cunningham U.S. Pat. No. 3,745,773, where a cone is positioned within a drilling frame above a wellhead to collect escaing gas and oil as drilling operations proceed.

SUMMARY OF THE INVENTION

This invention relates to a collector apparatus for use with a blown-out seabottom wellhead, including collector means having an extended, open base and an upper portion enclosing a volume to receive fluid comprising gas and lesser quantities of oil rising, in the water, from the wellhead, and a conduit-defining riser means connected to the collector means and extending thereabove to conduct the fluid therefrom According to the invention, the collector means comprises a plurality of collector elements, each having an extended, open base, a first collector element disposed below at least a second collector element with an open volume defined therebetween, the first collector element positioned to intercept fluid rising from the wellhead, and the second collector element positioned to receive and collect excess flow of the rising fluid that is not collected by the first collector element, the riser means comprising at least a first conduit-defining riser extending from the first collector element to the surface of the sea, and a second conduit-defining riser extending from the second collector element to a storage means above the second collector element, the first riser including an adjustable value means adapted to restrict flow through the riser whereby only a portion of gas from the blown-out wellhead is allowed to flow through the first riser and a further portion of gas and oil are rejected by the first collector element and flow into the second collector element, the second riser adapted to conduct gas in a gas-lift pumping flow rate capable of carrying water and accompanying oil from the second collector element to the storage means.

In preferred embodiments, the minimum distance, measured transversely to the axis of flow of the gas rising, in the water, from the wellhead between the axis and the base portion of at least one collector element is at least equal to one half the height of the base above the outlet of the blown-out wellhead; and where substantially all of the gas escaping from the wellhead is collected by the apparatus, the percentage of the oil released by the wellhead that is recovered by the collector apparatus varies directly with the dimensionless Froude Number (F), where $$F = \frac{Q_T}{\sqrt{gh^5}}$$

and $Q_T$=total collected liquid (oil and water) flow rate through the riser, g=acceleration of gravity, and h=vertical distance from wellhead outlet to base of the collector element.

In another aspect of the invention, the percentage of recovered oil (P) is a function of the Froude Number (F) and the Phase Ratio (R) according to the equation, $$P = 1 - \left[\exp\left(-\frac{A \times R \times F}{B + R}\right)\right]^c$$

where A, B and C are constants equal to 77.0311, 1.41879 and 0.42753 respectively. According to this aspect, the percentage of oil recovered the collector apparatus is substantially unaffected by Phase Ratio (R).

Also in preferred embodiments, at least two of the collector elements are substantially concentric; the base of at least one collector element is substantially concentric with the axis of flow of gas rising, in the water, from the wellhead; the first conduit-defining riser is contained within the second conduit defining riser; and the first riser and said second riser are substantially concentric.

In another aspect, the invention relates to a method of collecting hydrocarbon from a blown-out seabottom wellhead, including positioning a collector apparatus over the wellhead to contain fluid rising therefrom, the collector apparatus comprising a collector element having an extended, open base and an upper portion enclosing a volume to receive fluid comprising a substantial quantity of gas and lesser quantities of oil, and a conduit-defining riser connected to the collector element and extending thereabove to conduct the fluid therefrom.

According to this aspect of the invention, the method includes providing a plurality of collector elements, each having an extended, open base, disposing a first collector element below at least a second collector element, and defining an open volume therebetween, positioning the first collector element to intercept fluid rising from the wellhead, and positioning the second collector element to receive and collect excess flow of rising fluid that is not collected by the first collector element, providing riser means comprising at least a first conduit-defining riser extending from the first collector element to the surface of the sea, and a second conduit-defining riser extending from the second collector element to a storage means above the second collector element including in the first riser an adjustable value means, restricting flow through the riser and allowing only a portion of gas from the blown-out wellhead to flow through the first riser, causing a further portion of gas and oil to be rejected by the first collector element and flow into the second collector element, and causing the second riser to conduct gas in a gas-lift pumping flow rate to carry water and accompanying oil from the second collector element to the storage means.

The invention thus provides a collection apparatus for recovery of escaping gas and oil that separates a portion of the substantially excess volume of escaping gas from the similarly escaping oil to provide a gas-lift pumping system that is relatively unaffected by the phase ratio of the system and allows recovery of a previously unobtainable percentage of the oil escaping from a blown-out well.

These and other objects and features of the invention will be understood from the following description of a preferred embodiment.

PREFERRED EMBODIMENT

The structure and operation of a preferred embodiment of the invention will now be described, after first briefly describing the drawings.

Drawings

Structure

Figure 1:
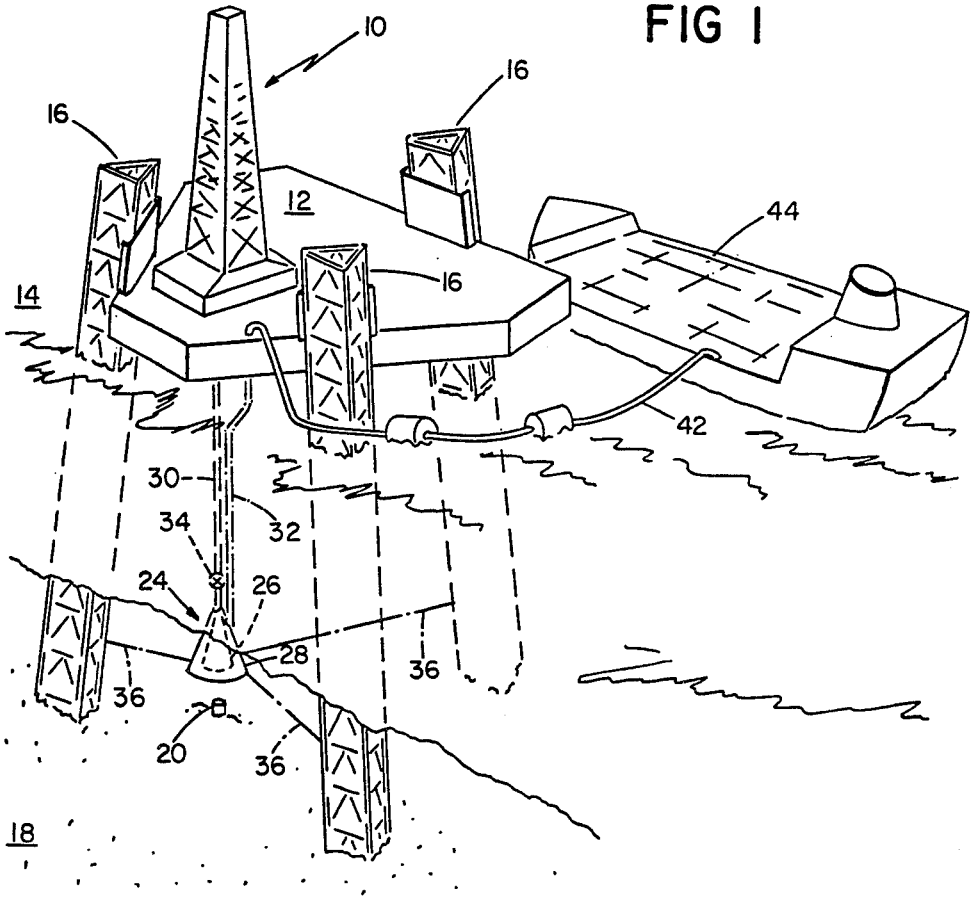
FIG. 1 is an isometric side view of a subsea oil well drilling operation employing the collector apparatus of the invention to contain a subsea well blow-out.

Referring to FIG. 1, an apparatus 10 for drilling subsea wells to recover petroleum, e.g. gas or oil, is shown. Jack-up platform 12, typically 60 meters (195 feet) across, is supported above the water surface 14 on trusses 16, typically 6 meters (20 feet) across, used in tripod configuration, reaching to ocean floor 18.

Located on ocean floor 18 is wellhead 20 through which drilling had been taking place but which has now "blown out".

Suspended below platform 12 at height (h), typically 9 meters (30 feet) or less, above the top of wellhead 20, is separating collector 24, comprised of two concentric cones 26, typically 9 meters (30 feet) in diameter, and 28, typically at least 12 meters (40 feet) in diameter, the inner volumes of which are connected to the platform surface 12 via marine risers 30, 32. Riser 30, typically 0.75 meter (30 inches) in diameter, from inner cone 26, which includes valve 34 to control the flow therethrough, is connected to drilling platform 12. Riser 32, typically 0.75 meter (30 inches in diameter from outer cone 28 is connected at its upper end 42 to oil tanker 44 operating at the surface 14 of the ocean.

Separating collector 24 is positioned over wellhead 20 by means of cables 36 from truss legs 16.

Analysis of Collector Operation

Analysis of experimental tests shows indicate that the percentage of escaping oil recovered (P) in a single cone collector is highly dependent on the total liquid and gas flow, which indicates that both the dimensionless Froude number (F), given by the equation:

$$F = \frac{Q_T}{\sqrt{gh^5}}$$

where $Q_T$=total collected liquid (oil and water) flow rate through the risers, g=acceleration of gravity, h=vertical distance from the wellhead to the base of the collecting element.

and the dimensionless phase ratio (R), given by the equation:

$$R = \frac{Q_T}{g_g}$$

where $Q_T$=total collected liquid (oil and water) flow rate through the risers, $g_g$=gas volume flow rate at the wellhead.

are of major importance if all the gas is collected. (Failure to collect some of the gas may result in better collection percentage, as result of higher phase ratio, but oil collection operations would not be feasible with significant quantities of gas allowed to escape because of the resulting dangerous surface conditions.)

Figure 6:
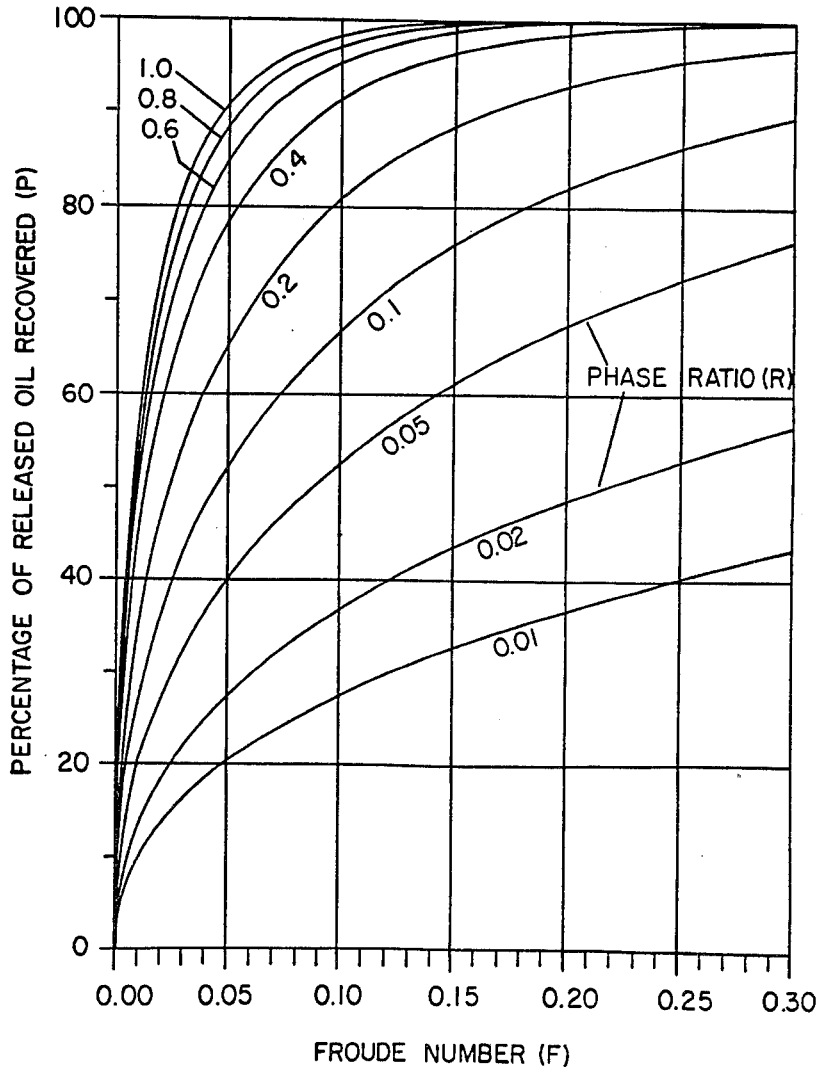
FIG. 6 is a graph of percent oil collected versus Froude number.

The percentage (P) of oil collected is a function of the Froude Number (F) and the Phase Ratio (R) according to the equation:

$$P = 1 - \left[\exp\left(-\frac{A \times R \times F}{B + R}\right)\right]^c$$

where a, b, and c are constants equal to 77.0311, 41879 and 0.42753 respectively. The percentage of oil collected versus Froude Number for various phase ratios is given in FIG. 6. As shown, a higher Froude Number and a higher Phase Ratio result in a higher percentage of collected oil recovered.

Operation

Referring again to FIG. 1, jackup platform 12 is floated into position over a prospective drilling site. Trusses 16, typically three are employed, are established on the ocean floor 18 and platform 12 is "jacked up" off the ocean surface (hence the name) to form a stable, drilling operation surface.

A wellhead 20 is established on the ocean floor 18 and drilling operations are commenced. If a blow-out occurs during the drilling, with the ensuing violent eruption of oil 44 and substantial volumes of gas 40, drilling operations cease and the drill string is broken off and withdrawn.

Collector apparatus 24 comprising concentric cones 26, 28, 9 and 12 meters in diameter, respectively, is lowered from drilling platform 12. Apparatus 24 is suspended by risers 30, 32 which connect the inner volumes of cones 26, 28, respectively, to the surface 14 and is positioned over the blowout by means of cables 36 connected to trusses 16.

The collector apparatus (24, FIG. 2) is positioned over wellhead 20 at a height (h) which is equal to the minimum diameter (w) of the base 27 of the collector element, in this case inner cone 26. This allows all of the escaping gas 40, which rises in the water in a conical plume diverging at a 60° angle to horizontal, to be collected in the apparatus 24. In this case, e.g., the base of the collector apparatus is positioned at least within 12 meters (the diameter of the base 29 outer cone 28) and preferably within 9 meters (the diameter of the base 27 of the inner cone 26) of the top of wellhead 20. In this manner, substantially all of the escaping gas 40 is collected within apparatus 24.

Figure 2:
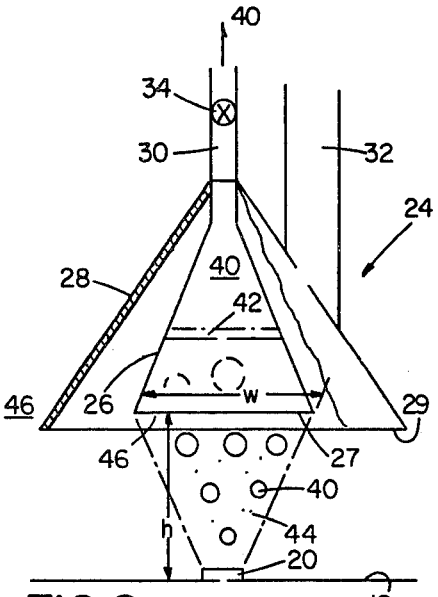
FIGS. 2, 3 and 4 are side views partially in section of the collector apparatus being positioned above a blown-out well and brought into collecting operation.

As shown in FIG. 2, as soon as collector apparatus 24 is positioned over the blown-out wellhead 20, gas 40 fills riser 30 and the upper portion of inner cone 26, with the gas/liquid interface 42 located between the opening of riser 30 and base 27 of inner cone 26.

The gas volume flow rate ($g_g$) at wellhead 20 of the blown-out well is substantial, particularly in the earlier stages of a blow out, and the volume of gas is substantially in excess of the volume desirable for gas-lift pumping in riser 30 to recover oil also rising from the wellhead and the entraining water.

This excess gas volume flowing in riser 30 substantially diminishes the volume ($Q_T$) of oil and water that can be carried to the surface in the riser by gas lift pumping as indicated (FIG. 6) by the resulting lower Froude Number (F) and lower Phase Ratio (R). The percentage of oil released from the wellhead recoverable through riser 30 from inner cone 26 is negligible. As shown in FIG. 2, the large volume of gas escaping from wellhead 20 forces the gas/liquid interface 42 to a position remote from the opening to riser 30. In this condition, substantially no liquid (water 46/oil 44) is carried up riser 30 by the escaping gas 40, and substantially no gas 40 escapes from within inner cone 26 to outer cone 28. (Due to the highly turbulent nature of interface 42, liquid recovery and escape of some gas and oil will periodically occur.)

Figure 3:
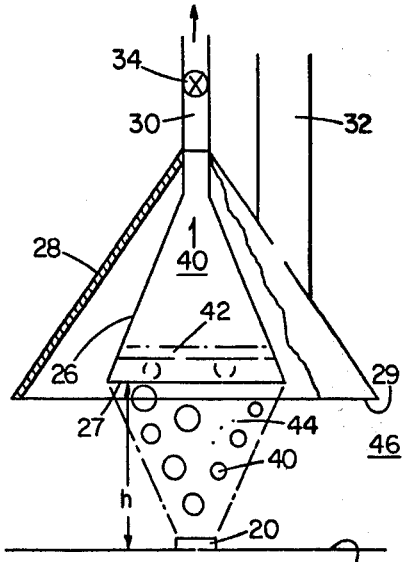
Figure 4:
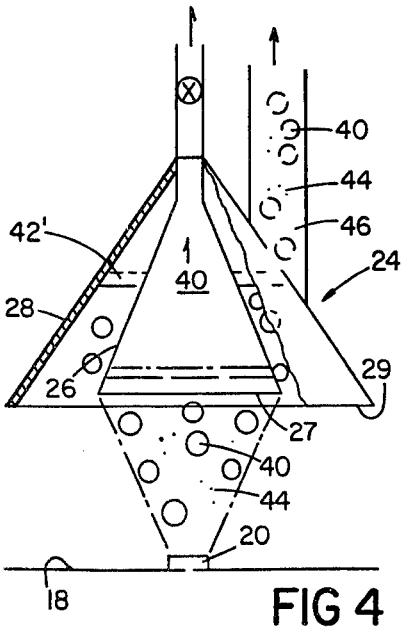

Referring now to FIG. 3, valve 34 in inner cone riser 30 is operated to restrict the flow of gas 40 in riser 30. This causes the liquid/gas interface 42 to move lower in inner cone 26, i.e. the interface 42 is closer to the base 27 and further from the opening to riser 30. By this means, more gas 40 is caused to escape from within inner cone 26 to be collected within outer cone 28 and substantially all of the oil 44 escapes into outer cone 28. (The lower interface also ensures that primarily only gas 40 will be pass up riser 30, i.e. "choked flow".)

The gas/liquid interface 42 in outer cone 28 is maintained, by the volume of gas 40 caused to escape from inner cone 26 into outer cone 28 which is controlled by the position of restriction valve 34, for optimum gas lift pumping in riser 32, i.e. the volume of escaping gas 40 is regulated to deliver the maximum volume of collected liquid $Q_T$ from within outer cone 28.

The position of valve 34 is adjusted periodically in response, e.g., to changes in gas flow ($g_g$) from the blown-out well 20 to maintain optimum gas-lift pumping in riser 32.

The liquid, typically large volumes of water 46 with oil 44 droplets entranced therein, carried by the gas 40 in riser 32 is delivered to oil tanker 44, where separation of the gas, oil and water takes place by known means.

OTHER EMBODIMENTS

Figure 5:
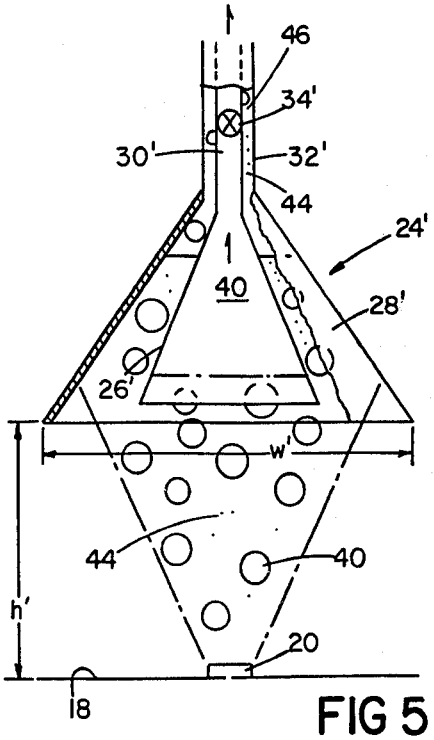
FIG. 5 is a side view partially in section of another embodiment, of the collector apparatus.

Other embodiments of the invention are within the following claims. For example, as shown in FIG. 5, the collector apparatus 24' may be located above wellhead 20 at height (h') equal to the minimum diameter (w') of the base 29 of outer cone 28 in a position where a portion of the escaping gas 40 is first collected by outer cone 28'. The apparatus performs as above, with the valve 34' controlled to cause a sufficient volume of additional gas 40 to escape from inner cone 26' into outer cone 28' for optimum gas-lift pumping in riser 32'. Also, the risers 30', 32' may be concentric, and the collector elements may be any shape adapted to contain a volume of gas and oil rising in the water.

1. A collector apparatus for use with a blown-out seabottom wellhead, said apparatus comprising a collector means having an extended, open base and an upper portion enclosing a volume to receive fluid comprising gas and lesser quantities of oil rising, in the water, from the wellhead, and a conduit-defining riser means connected to said collector means and extending thereabove to conduct said fluid therefrom said apparatus characterized in that said collector means comprises a plurality of collector elements, each having an extended, open base, a first said collector element disposed below at least a second said collector element with an open volume defined therebetween, said first collector element positioned to intercept said fluid rising from said wellhead, and said second collector element positioned to receive and collect excess flow of said rising fluid that is not collected by said first collector element, said riser means comprising at least a first conduit-defining riser extending from said first collector element to the surface of the sea, and a second conduit-defining riser extending from said second collector element to a storage means above said second collector element said first riser including an adjustable valve means adapted to restrict flow through said riser whereby only a portion of gas from said blown-out wellhead is allowed to flow through said first riser and a further portion of gas and oil are rejected by said first collector element and flow into said second collector element, said second riser adapted to conduct gas in a gas-lift pumping flow rate capable of carrying water and accompanying oil from said second collector element to said storage means.

2. The collector apparatus of claim 1 characterized in that the minimum distance, measured transversely to the axis of flow of said gas rising, in said water, from said wellhead between said axis and the base portion of at least one said collector element is at least equal to one half the height of said base above the outlet of said blown-out wellhead.

3. The collector apparatus of claim 1 characterized in that where substantially all of the gas escaping from said wellhead is collected by said apparatus, the percentage of the oil released by said wellhead that is recovered by means of said collector apparatus varies directly with the dimensionless Froude Number (F), where $$F = \frac{Q_T}{\sqrt{gh^5}}$$

and $Q_T$=total collected liquid (oil and water) flow rate through said riser, g=acceleration of gravity, and h=vertical distance from wellhead outlet to base of said collector element.

4. The collector apparatus of claim 1 wherein the fraction of recovered oil (P) is a function of the Froude Number (F) and Phase Ratio (R) according to the equation, $$P = 1 - \left[\exp\left(-\frac{A \times R \times F}{B + R}\right)\right]^c$$

where A, B and C are constants equal to 77.0311, 1.41879 and 0.42753 respectively, characterized in that the percentage of oil recovered by means of said collector apparatus is substantially unaffected by Phase Ratio (R).

5. The collector apparatus of claim 1 characterized in that at least two said collector elements are substantially concentric.

6. The collector apparatus of claim 1 characterized in that the base of at least one said collector element is substantially concentric with the axis of flow of gas rising, in the water, from said wellhead.

7. The collector of claim 1 characterized in that said first conduit-defining riser is contained within said second conduit defining riser.

8. The collector apparatus of claim 1 characterized in that said first riser and said second riser are substantially concentric.

9. The collector apparatus of claim 1 characterized in that said adjustable valve is adapted to restrict the flow of gas in said first riser for choked flow whereby substantially no liquid is carried by the gas through said first riser.

10. The collector apparatus of claim 1 characterized in that the volume enclosed by said first collector element is disposed substantially within the volume enclosed by said second collector element.

11. A method of collecting hydrocarbon from a blown-out seabottom wellhead, said method including positioning a collector apparatus over said wellhead to contain fluid rising therefrom, said collector apparatus comprising a collector element having an extended, open base and an upper portion enclosing a volume to receive fluid comprising a substantial quantity of gas and lesser quantities of oil, and a conduit-defining riser connected to said collector element and extending thereabove to conduct said fluid therefrom, said method characterized by the steps of providing a plurality of collector elements, each having an extended, open base, disposing a first said collector element below at least a second said collector element, and defining an open volume therebetween, positioning said first collector element to intercept said fluid rising from said wellhead, and positioning said second collector element to receive and collect excess flow of said rising fluid that is not collected by said first collector element, providing said riser means comprising at least a first conduit-defining riser extending from said first collector element to the surface of the sea, and a second conduit-defining riser extending from said second collector element to a storage means above said second collector element including in said first riser an adjustable value means, restricting flow through said riser and allowing only a portion of gas from said blown-out wellhead to flow through said first riser, causing a further portion of gas and oil to be rejected by said first collector element and flow into said second collector element, and causing said second riser to conduct gas in a gas-lift pumping flow rate to carry water and accompanying oil from said second collector element to said storage means.

* * * * *